US009011297B2

(12) United States Patent
Sagall

(10) Patent No.: US 9,011,297 B2
(45) Date of Patent: Apr. 21, 2015

(54) UNIVERSAL PUNCHING BAG SUPPORT APPARATUS

(71) Applicant: Jason Sagall, Tustin, CA (US)

(72) Inventor: Jason Sagall, Tustin, CA (US)

( * ) Notice: Subject to any disclaimer, the term of this patent is extended or adjusted under 35 U.S.C. 154(b) by 116 days.

(21) Appl. No.: 13/631,966

(22) Filed: Sep. 29, 2012

(65) Prior Publication Data

US 2014/0094350 A1 Apr. 3, 2014

(51) Int. Cl.

| | |
|---|---|
| ***A63B 21/00*** | (2006.01) |
| ***A63B 69/20*** | (2006.01) |
| ***A63B 71/02*** | (2006.01) |
| ***A63B 21/16*** | (2006.01) |

(52) U.S. Cl.

CPC ..... *A63B 69/201* (2013.01); *A63B 69/205* (2013.01); *A63B 71/023* (2013.01); *A63B 21/1627* (2013.01); *A63B 21/1636* (2013.01); *A63B 2210/50* (2013.01); *A63B 2225/09* (2013.01); *Y10S 482/904* (2013.01)

(58) Field of Classification Search

USPC ..... 482/83, 84, 85, 86, 87, 88.89, 90, 904

See application file for complete search history.

(56) References Cited

U.S. PATENT DOCUMENTS

| | | | |
|---|---|---|---|
| 695,187 | A | 3/1902 | Whitney |
| 717,273 | A | 12/1902 | Reach |
| 1,242,626 | A | 10/1917 | Wilson |
| 1,553,664 | A | 9/1925 | Bergmann |
| 2,709,082 | A | 5/1955 | Klaudt |
| 4,050,693 | A | 9/1977 | Lichterman |
| 2012/0046150 | A1 | 2/2012 | Stacey |

OTHER PUBLICATIONS

Kapulka, "Inventors' 'Eye of the Tiger'", Citrus County Chronicle Online, Mar. 28, 2012, Homosassa, Florida.

*Primary Examiner* — Jerome W Donnelly

(57) ABSTRACT

This disclosure describes an apparatus and methods to support a punching bag, or a punching bag and rebound platform, within a doorway or other architectural opening. Mounting the apparatus does not involve modifying or altering the supporting architectural structures and surfaces (e.g., with screws, brackets, adhesives, etc.). Clamps are instrumental in safely securing the apparatus and stabilizing it for high-performance use of a plurality of punching bags. Adjustment mechanisms not only facilitate the mounting of the apparatus to a plurality of doorframes and other architraves but also accommodate the height and depth preferences of a user. In addition, a folding mechanism allows the apparatus to be compacted for storage or transport.

3 Claims, 10 Drawing Sheets

UNIVERSAL PUNCHING BAG SUPPORT APPARATUS

BACKGROUND OF THE INVENTION

It is known to support a punching bag by attaching it to a stable structure for appropriate use. Previous references include those that teach a punching bag support method involving, for example, an exercise machine, telescoping poles, a freestanding apparatus, or various apparatuses that mount to a ceiling or overhead architectural structure, a wall, a door, a doorframe, a ceiling and a floor, or a ceiling and a wall.

As used herein, a "punching bag support apparatus," or "support apparatus," is an apparatus made to support a plurality of types of punching bags, including weighted or inflated bags—for example: a heavy bag, angle bag, focus bag, or speed bag. In the example of a speed bag, the support apparatus is made to also support a horizontal rebound drum, more commonly known, and referred to herein, as a rebound platform or simply a platform.

In fact, a speed bag requires special considerations to support the bag for proper use. A speed bag is typically an air-inflated, teardrop-shaped punching bag about nine inches in height, rotatably attached to a rebound platform, from which the bag hangs and which provides a solid rebound surface for the bag when in use. After being struck by a user, a speed bag rebounds off of the platform quickly, usually two or more times after every strike, such that the user can strike the bag repeatedly and rhythmically and keep it in continuous motion. Since this type of use requires minimal loss of energy in the struck bag, the platform and the accompanying means of support require substantial rigidity and stability. While the degree to which a platform vibrates is determined in part by the density of the platform's material, its overall stability and effectiveness for speed bag performance is largely affected by the method or apparatus by which the platform is mounted. A platform or support apparatus that is generally unstable or that significantly vibrates will deaden the rebound of the bag and thus hinder the user from striking the bag with the speed and rhythm that is paramount to speed bag users.

Previous references that could provide support for a type of punching bag other than a speed bag and rebound platform—for example, a heavy bag or focus bag—fail at least to also provide adequate support for a speed bag and rebound platform.

Previous references that could provide support for a speed bag and rebound platform fail at least to employ a means or apparatus that would also provide adequate support for other types of punching bags.

Further, previous references that could provide support for a speed bag and rebound platform fail at least to provide such support in one or more of the following ways:

1) The reference fails to employ a method or apparatus that would not effectively alter or modify the supporting structures (for example, a wall or ceiling), in that it utilizes screws, bolts, anchors, nails, adhesives, or other fastening methods that would penetrate the supporting structures in order to achieve a requisite level of support;
2) The reference fails to employ a method or apparatus that would not cause markings or indentations to the supporting structures, in that the apparatus invariably presses into the supporting structures in order to achieve a requisite level of support or as a result of movement during punching bag use;
3) The reference fails to employ a method or apparatus that would not be a safety hazard, in that its mounting or tensioning means do not ensure against the slipping or falling of the apparatus as a result of movement during punching bag use or merely under the force of gravity;
4) The reference fails to employ a method or apparatus that would achieve a level of stability and performance required for speed bag use as described above, in that it does not provide for the use of a solid rebound platform or does not provide requisite high-rebound and low-vibration characteristics.

Thus, there is still a need for a punching bag support apparatus that is not subject to the limitations and problems enumerated above.

These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary.

As used herein, the phrases "coupled to," "coupled with," and "attached to" are used synonymously. Unless the context dictates otherwise, the term "coupled" and the term "attached" are intended to include both direct coupling (in which two elements, components, or members that are coupled to each other contact each other) and indirect coupling (in which at least one additional element, component, or member is located between the two elements, components, or members).

Moreover, elements, components, or members that are described as "coupled" or "attached" in a given embodiment are not necessarily mutually exclusive of each other in form or function across all embodiments comprising similar elements, components, or members. Nonetheless, as coupled or attached, the elements, components, or members integrate to establish the overall form and function as described.

BRIEF SUMMARY OF THE INVENTION

These teachings provide apparatus, systems and methods for which a punching bag, or a punching bag and a rebound platform, can be mounted and secured to a plurality of architectural openings, including various architraves, e.g., a doorframe, such that the mounting utilizes surrounding architectural structures and surfaces without modification, alteration, or injury to those structures and surfaces, and such that the apparatus as mounted provides sufficient stability for repetitive striking of a punching bag.

A support apparatus is envisioned to have at least one bag-support member, to which a punching bag could be attached, or to which a horizontal rebound platform could be attached as in the case of, for example, a speed bag application.

In one embodiment, the bag-support member could be sized and disposed to be, for example, at least 50%, 70%, or 90% of the width of a doorway and centered between a left vertical side and a right vertical side of a doorframe of the doorway. In another embodiment, the bag-support member could comprise a horizontal, elongated member that is greater than the width of the doorway and that could extend beyond the left vertical side and the right vertical side of the doorframe, abutting the doorframe on a front-left side and a front-right side, respectively. In another embodiment, a modified version of the horizontal, elongated member could be telescoping on at least one end, allowing its length to be adjusted to suit a plurality of doorframes and architectural spaces.

The bag-support member could be adjustably coupled to an upper clamp assembly attached to an upper portion of the doorframe such that, as mounted, the support apparatus is proximate to the doorframe at a plurality of heights and depths to facilitate the use of a plurality of punching bags. The upper clamp assembly could assist in generally securing the apparatus in its mounted position and reducing movement of the apparatus during punching bag use. The upper clamp assembly could include one or more clamps comprised of at least one front member, at least one rear member, and at least one tightening mechanism, such that each clamp in the assembly could be tensioned around a front side and a rear side of the doorframe. Such clamping means could prevent the apparatus from being jarred from its mounted position and falling as a result of lateral movement of the punching bag or, in particular, by upward movement of a speed bag rebounding against an attached platform.

In some embodiments, the upper clamp assembly is envisioned to include a rigid, elongated, horizontal member that supports at least a portion of the weight of the apparatus by being sized and disposed to abut a top surface of the upper portion of the doorframe on, for example, the rear side of the doorframe. The horizontal member could span greater than 60%, 80% or 90% of the width of the doorway and could be coupled to one or more shorter elongated, horizontal members that each spans, for example, less than 20% or 30% of the width of the doorway, and that are sized and disposed to abut a top surface of an upper portion of the doorframe on a side opposite the longer horizontal member—e.g., on a front side.

In another embodiment, the horizontal member of the shorter length as described above could be utilized similarly to abut the upper portions of the doorframe on both the front side and the rear side. Alternatively, the horizontal member of the longer length as described above could be utilized similarly to abut the upper portions of the doorframe on both sides. Further, one or more of such configurations in one or more combinations of multiple longer and shorter horizontal members could comprise the upper clamp assembly of the support apparatus without departing from the scope of these teachings.

One or more bag-support members could be coupled to the upper clamp assembly using at least one rigid vertical element. The vertical element could comprise, for example: a bracket about five inches wide and one quarter inch thick, or a round tube that is about one inch in diameter, or about a one-inch square tube. Alternatively, a plurality of brackets or tubes could be employed in front-and-rear or side-by-side configurations relative to the depth and the width of the doorway, respectively. In some embodiments, such bag-support members and vertical elements are envisioned to be vertically telescoping on at least one end, allowing the length of each to be adjusted to suit a plurality of doorframes and architectural spaces.

Such vertical elements could comprise a series of coupling points such as holes, indents, tracks, or slots, for example, arranged vertically such that the coupling between the bag-support members and the upper clamp assembly is vertically adjustable—for example: in at least one-inch or two-inch increments, or infinite sliding adjustability, within a span of at least one foot. Such vertical variability could allow the bag-support members, and thus the punching bag itself, to be raised or lowered to suit the preference of a user.

Similarly, one or more of the bag-support members could comprise a series of coupling points arranged horizontally such that the coupling between the bag-support member and the upper clamp assembly could also be horizontally adjustable—for example: in at least one-half-inch or one-inch increments, or infinite sliding adjustability, within a span of at least three inches. Such horizontal variability could allow the bag-support member, and thus the punching bag itself, to be positioned forward or backward, relative to the depth of the doorway, to suit the preference of the user. Further, in an embodiment comprising a bag-support member configured as an elongated horizontal member that abuts the front-left side and the front-right side of the doorframe, such horizontal adjustment in the coupling of the bag-support member to the upper clamp assembly could facilitate the mounting of the apparatus with an attached rebound platform in doorways with a plurality of frame dimensions—for example, 5 inches deep, 6½ inches deep, or 7 inches deep, such that the platform rests in a perfectly level position.

In some embodiments, the coupling between the horizontal and vertical elements of the bag-support members is envisioned to be rotatable in order to compact the apparatus when unmounted, to allow more convenient storage or ease in transport, for example.

To further secure the support apparatus to the doorframe, a left-side clamp assembly and a right-side clamp assembly are envisioned. These side clamp assemblies could each be comprised of one or more elongated members in the sizes and configurations described herein for the upper clamp assembly. In some embodiments, the left-side clamp assembly and the right-side clamp assembly could be coupled to at least one of the bag-support members adjustably, such that the coupled members as a whole can be sized and disposed to mount to a plurality of doorway widths, depths, and doorframe dimensions.

It is envisioned that any of the clamp assemblies could comprise at least one or two support materials: a first material that is at least semi-rigid, to provide the primary structure of the clamp; and a second material that comprises a padding, to provide protection to the surfaces of the doorframe, wall or other architectural structures with which the clamp comes into contact. Moreover, a plurality of padding materials could be employed on the clamps or any part of the support apparatus to provide grip, or to protect against scratches or blemishes on the architectural surfaces, or to dampen vibration of the apparatus during punching bag use, or to absorb shock to the apparatus or the architectural structures during punching bag use. Alternatively, the first material could comprise a semi-rigid material that also functions as a padding material, such as a hard rubber. Such a material could be the only material of which the clamps are comprised. Contemplated semi-rigid or rigid materials include, but are not limited to, steel, aluminum, hardwood, fiberglass, hard plastic, and hard rubber. Contemplated padding materials include, but are not limited to, soft rubber, foam rubber, soft plastic, vinyl, felt, and cloth.

The support apparatus is further envisioned to comprise at least one attachment mechanism to allow coupling with a known punching bag attachment device, such as an S-hook or a spring hook, which could allow the attachment of a plurality of types of punching bags. The support apparatus could have at least one such attachment mechanism for a punching bag to be used without a rebound platform, in addition to an attachment mechanism to allow coupling with a rebound platform, to which a speed bag could be attached via a known swivel hook, for example.

The support apparatus is envisioned to comprise a material that could support a punching bag of any known weight, for example: 10 lbs, 50 lbs, 100 lbs, or heavier; and any known size, for example: 6 inches, 8 inches, 12 inches, or larger; and any known filling, for example: air (inflated), fiber, or foam.

The support apparatus is envisioned to comprise a material that could support a rebound platform of any known material, for example: wood or plastic; and any known weight, for example: 10 lbs, 20 lbs, 30 lbs, or heavier; and any known length and width, for example: 12 inches by 18 inches, 18 inches by 18 inches, 18 inches by 24 inches, or larger; and any known shape, for example: a perfect or modified circle, square or rectangle, or an irregular shape; and any known thickness, for example: ¾ inch, 1 inch, 3 inches, or greater.

Various objects, features, aspects, and advantages of the inventive subject matter will become more apparent from the following detailed description of alternative embodiments, along with the accompanying drawing figures in which like numerals represent like components.

BRIEF DESCRIPTION OF THE SEVERAL VIEWS OF THE DRAWING

FIG. 6 illustrates: a bag-support member comprising two vertical elements; and an upper clamp assembly comprising two tightening mechanisms and one common, elongated horizontal rear member.

DETAILED DESCRIPTION OF THE INVENTION

Figure 1:
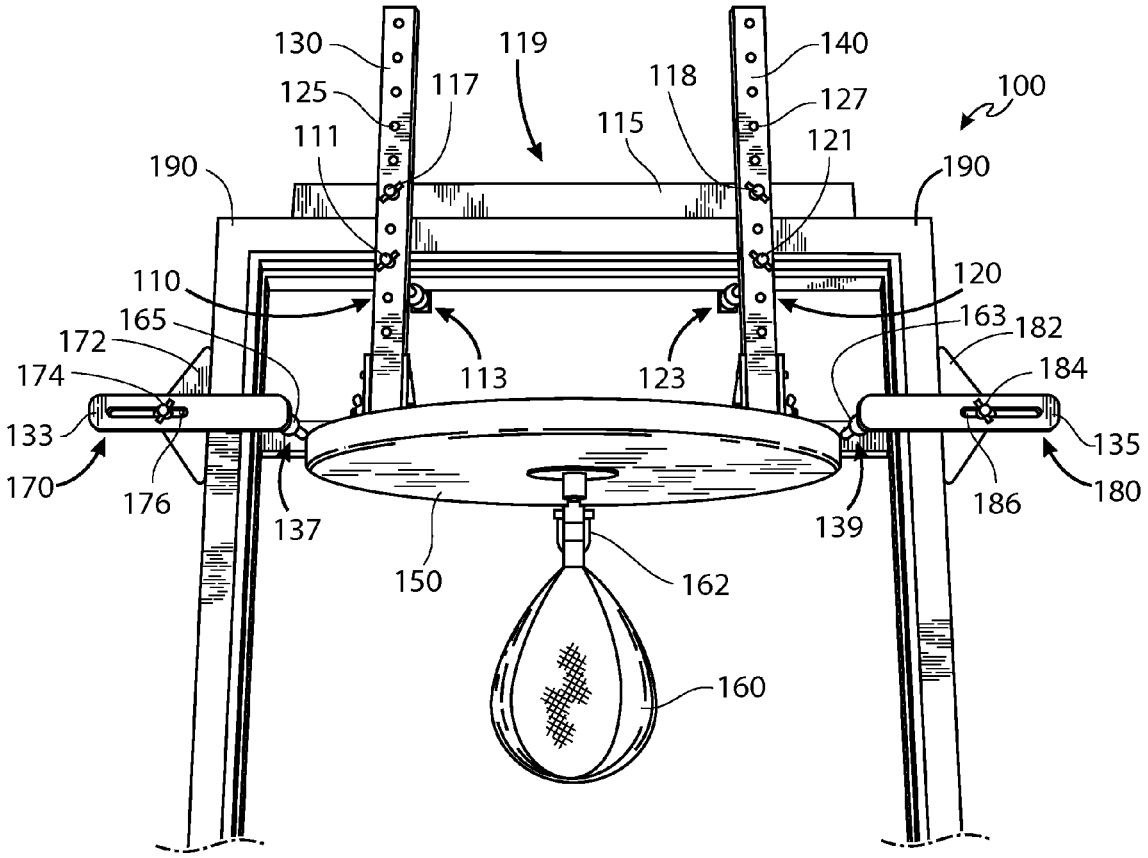
FIG. 1 is a rear perspective view of an embodiment of the disclosed support apparatus to which a speed bag and a rebound platform are attached.

Previous support methods that rely on clamping suffer from the dilemma that, in order to achieve optimal support and stability by clamps alone, a support apparatus would have to be lighter than a weight that would maximize performance use. Previous methods that rely on leveraging suffer from the dilemma that, in order to achieve optimal support and stability by leverage points alone, the support apparatus would have to be heavier than a weight that would be necessary for high-performance use, and this could make installation more difficult or impossible in some situations. Therefore, by either method, apparatus usability and performance must be compromised for the sake of clamping or leveraging effectiveness.

The disclosed methods provide several advantageous technical effects over previous methods. The methods herein teach a clamping and leveraging support means together, such that the two work integrally and optimally in a plurality of embodiments. No longer must the apparatus's weight be contingent upon support and stability factors. The result demonstrates how both support and performance can be maximized without conflict.

A particular advantage of the disclosed methods is clamping that requires minimal tensioning and assists in safely securing a support apparatus—with either a punching bag by itself or a punching bag attached to a rebound platform—within a direct space of an architectural opening, such as a doorway. In contrast, a support method that relies primarily or solely on leveraging the weight of an apparatus against, for example, a doorframe or door, may require an indirect, horizontally displaced mounting of the apparatus—i.e., away from the direct space of the doorway—such that it protrudes into, for example, an adjacent room, in order for the leverage to be sufficient to achieve a requisite level of support, stability, or safety.

A further advantage of the disclosed methods is the obviating of a need for additional supporting members, such as a wall brace or a ceiling brace. Yet another advantage is the obviating of a need for an installation that requires, for example, screwing support brackets into a doorframe, or drilling holes into wall studs—or any modifications or alterations, for that matter, to the supporting structures. Other advantages include the ability to easily mount and unmount, with a single apparatus, a conventional speed bag and rebound platform—or a plurality of punching bag types—and achieve a level of performance that meets or exceeds known apparatuses.

The following discussion provides many example embodiments of the inventive subject matter. Although each embodiment represents a single combination of inventive elements, the subject matter is considered to include all possible combinations of the disclosed elements. Thus if one embodiment comprises elements A, B, and C, and a second embodiment comprises elements B and D, then the inventive subject matter is also considered to include other, remaining combinations of A, B, C, or D, even if not explicitly disclosed.

In FIG. 1, an embodiment of a support apparatus 100 is shown from a rear view, mounted to a doorframe 190. In this embodiment, the apparatus 100 supports a speed bag 160 and a rebound platform 150. A known swivel device 162 attaches speed bag 160 to rebound platform 150. Doorframe 190 is contemplated to have an inner width of about 30 inches, although the inner width could be as narrow as about 24 inches or as wide as about 40 inches for this embodiment of the apparatus. The shape of rebound platform 150 is contemplated to be circular but could be a plurality of shapes. Rebound platform 150 is contemplated to have a diameter of about 23 inches; however, that diameter could be as great as the inner width of doorframe 190 or as small as the distance between two contact points 180 degrees apart where speed bag 160 rebounds off of rebound platform 150 after being struck. Rebound platform 150 is further contemplated to have a thickness of about 1 inch; however, the thickness of rebound platform 150 could be greater or less than 1 inch—for example, ½ inch or 3 inches. The material of rebound platform 150 is contemplated to be comprised of solid wood but could be a plurality of materials, solid or otherwise—for example: wood comprising internal chambers, or solid plastic, or cushioned plastic. Further, speed bag 160 could be air-inflated or any known type, and could be, for example, about 9 inches high, or any known size and shape of punching bag.

Continuing FIG. 1, the support apparatus 100 comprises a first vertical element 130 and a second vertical element 140, both of which abut doorframe 190 and function as rear clamp members of an upper clamp assembly 119 (further described below for FIG. 2). A horizontal clamp member 115 rests abuttingly on a top surface of doorframe 190 and thereby leverages a weight of the apparatus 100. Horizontal clamp member 115 is shown coupled to vertical elements 130 and 140 by a first T-knob fastener 117 and a second T-knob fastener 118, respectively. Thusly, FIG. 1 (and the corresponding front view of FIG. 2) represents one contemplated system that combines a leveraging method and a clamping method integrally in one embodiment of the support apparatus 100.

While FIG. 1 shows horizontal clamp member 115 coupled about midway along the length of vertical elements 130 and 140, T-knob fasteners 117 and 118 can be inserted into any one of a plurality of holes 125 and 127, respectively, to vertically adjust the distance of horizontal clamp member 115 from the attached rebound platform 150. Similarly, a first T-knob fastener 111 and a second T-knob fastener 121 can be inserted into any one of the plurality of holes 125 and 127, respectively, to vertically position a tightening mechanism 113 and a tightening mechanism 123, respectively. This configuration represents one contemplated method for adjusting speed bag 160 appropriately for the height of a user.

Note that in other contemplated embodiments not shown but similar to that of FIG. 1, vertical elements 130 and 140 could be sized and disposed such that they do not abut the upper portion of doorframe 190 as in FIG. 1 but rather are configured entirely below it. In such configurations, vertical elements 130 and 140 would not necessarily function as rear clamp members of upper clamp assembly 119 but could be coupled to upper clamp assembly 119, which could comprise a plurality of rear clamp members similar to front clamp members 122 (FIG. 2) and 147 (FIG. 2) of an upper clamp 120, and front clamp members 112 (FIG. 2) and 148 (FIG. 2) of an upper clamp 110. Alternatively, upper clamp assembly 119 could comprise horizontal clamp member 115 and a similarly sized clamp member (not shown) on the opposing side of doorframe 190.

Also shown in FIG. 1 is a right-side clamp assembly 170 and a left-side clamp assembly 180 (named relative to a front side of the apparatus, as in FIG. 2), each clamped onto a respective side of doorframe 190. Right-side clamp assembly 170 is shown comprised of a rear clamp member 133 coupled to a rear clamp member 172 wherein a T-knob fastener 174 adjusts the coupling of rear clamp members 133 and 172 via a slot 176 in rear clamp member 133, such that rear clamp member 172 abuts doorframe 190. A tightening mechanism 137 brings the rear clamp member 133 and a first bag-support member 154 (FIG. 2) toward each other and tensioned around doorframe 190 by turning T-knob fastener 153 (FIG. 2), which passes through any one of a plurality of holes 149 (FIG. 2) and threads into a mating part 165 coupled to rear clamp member 133. Likewise, a left-side clamp assembly 180 is configured in the same manner as right-side clamp assembly 170, but on the left side of doorframe 190. The plurality of holes 149 (FIG. 2) provides one contemplated means of adjustability such that left-side clamp assembly 180 and right-side clamp assembly 170 may be positioned appropriately for the width of doorframe 190.

Figure 2:
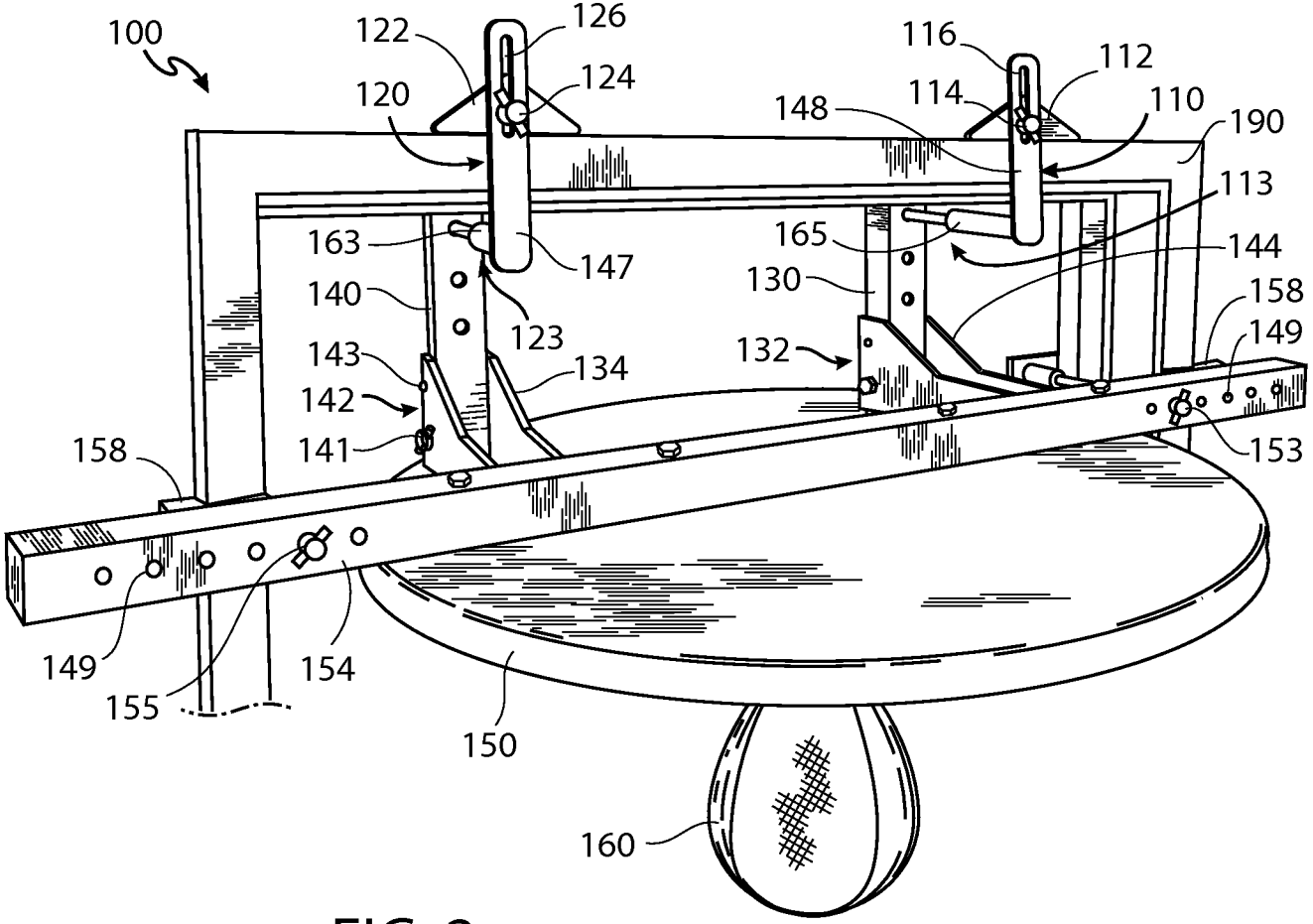
FIG. 2 is a front perspective view of the embodiment of FIG. 1.

In FIG. 2, a front view of the embodiment of FIG. 1, bag-support member 154 is contemplated to be a hollow tube made of a rigid material such as aluminum or steel, as are vertical elements 130 and 140. Bag-support member 154 is illustrated as about 1¼-inch square and about 44 inches long. Note, however, that in other embodiments not shown, bag-support member 154 and vertical elements 130 and 140 are contemplated to be a plurality of shapes and dimensions—for example: at least a ¾-inch, 1-inch or 2-inch square or other multi-sided tube, or a round tube about ¾ inch or greater in diameter, or a round or multi-sided telescoping tube that adjusts in length to fit an available space proximate to a doorway, or a rigid, relatively flat, non-tubular material.

In the embodiment of FIG. 2, bag-support member 154 abuts the left side and right side of doorframe 190 and thereby functions as a front clamp member of right-side clamp assembly 170 (FIG. 1) and a front clamp member of left-side clamp assembly 180 (FIG. 1). A padding material 158 is shown between bag-support member 154 and the left side and right side of doorframe 190. The dual-purpose functionality of bag-support member 154, such that it leverages apparatus 100 against the front of doorframe 190 and also serves as one of the front clamp members of right-side clamp assembly 170 (FIG. 1) and left-side clamp assembly 180 (FIG. 1), further demonstrates a method of combining leveraging and clamping integrally in support apparatus 100.

Note that in other contemplated embodiments not shown but similar to that of FIG. 2, bag-support member 154 could be a length less than the inner width of doorframe 190 and would not necessarily abut the left side or the right side of doorframe 190. In those embodiments, bag-support member 154 would not necessarily serve as the front clamp member of right-side clamp assembly 170 (FIG. 1) or of left-side clamp assembly 180 (FIG. 1), but rather could be centered between the left side and the right side of doorframe 190 and could be coupled to right-side clamp assembly 170 (FIG. 1) and left-side clamp assembly 180 (FIG. 1), each comprising a plurality of front clamp members similar to rear clamp members 133, 172, and 135, 182, on the left side and right side of doorframe 190, respectively.

Also shown in FIG. 2 is the front side of upper clamp assembly 119 (FIG. 1), comprising upper clamp 110 and upper clamp 120, each clamped onto doorframe 190. Upper clamp 110 is shown comprised of a front clamp member 148 coupled to a front clamp member 112 wherein a T-knob fastener 114 adjusts the coupling of front clamp members 148 and 112 via a slot 116 in front clamp member 148, such that front clamp member 112 abuts doorframe 190. A tightening mechanism 113 brings the front clamp member 148 and vertical member 130 toward each other and tensioned around doorframe 190 by turning T-knob fastener 111 (FIG. 1), which passes through any one of the plurality of holes 125 (FIG. 1) and threads into a mating part 165 coupled to front clamp member 148. Upper clamp 120 is configured in the same manner as upper clamp 110 but is proximate to the left side, instead of the right side, of doorframe 190.

Figure 3:
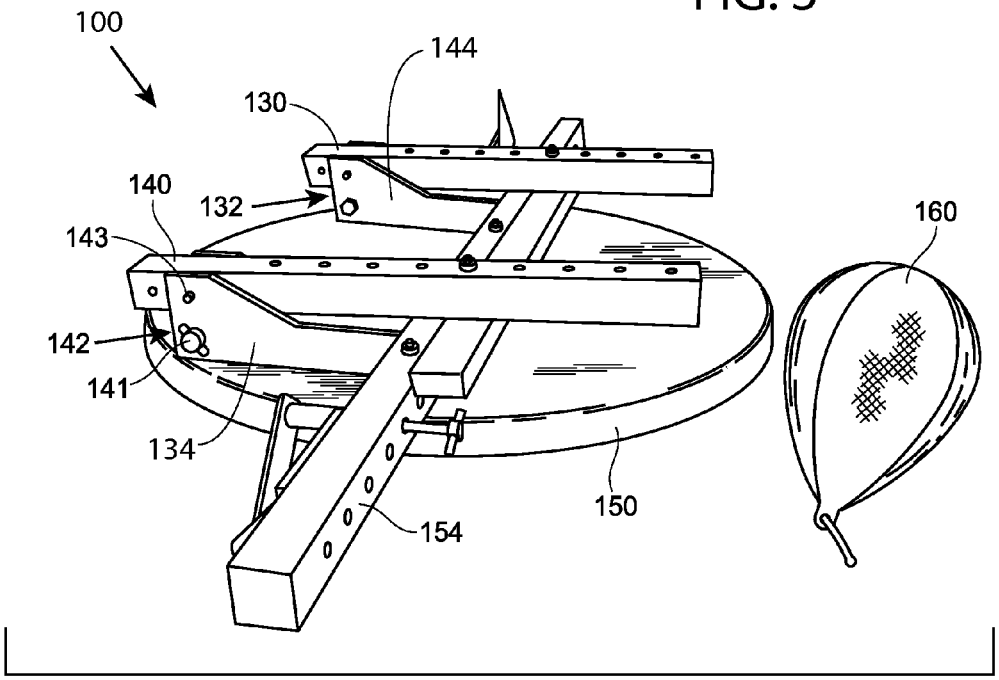
FIG. 3 is a top perspective view of the embodiment of FIG. 1, unmounted and folded into a storage position.
Figure 5:
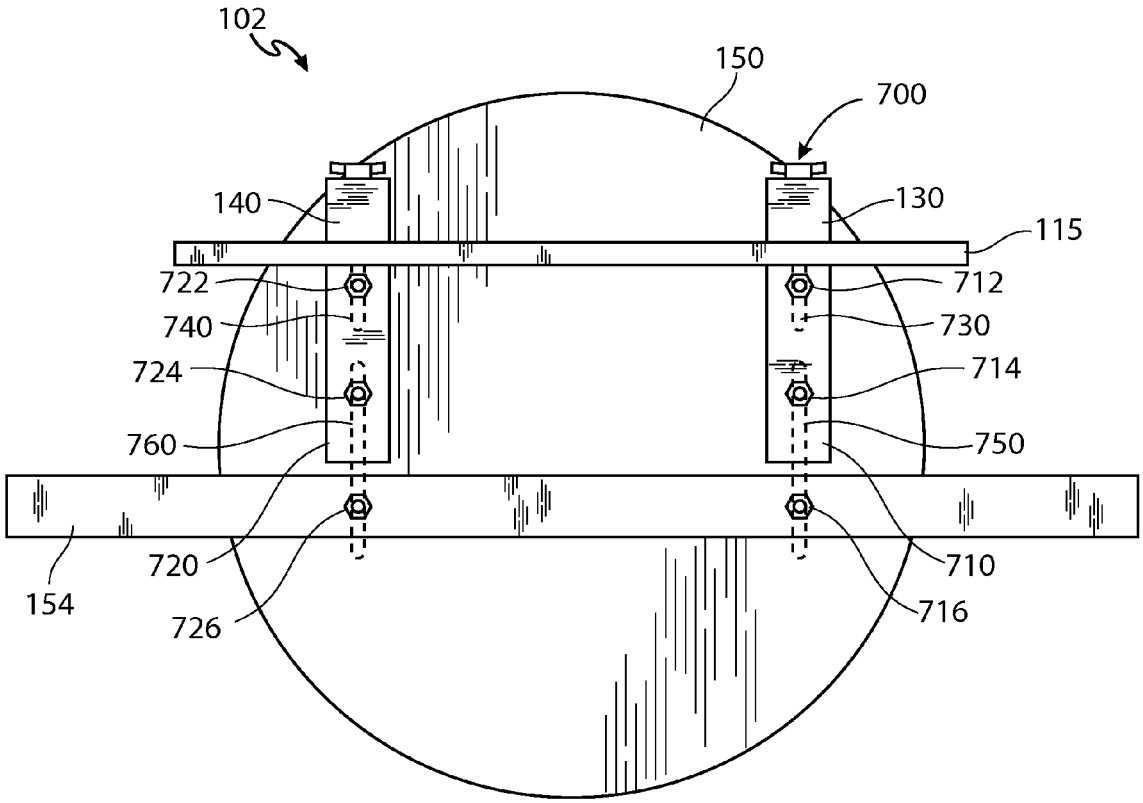
FIG. 5 is a top plan view of another alternative embodiment of the apparatus, illustrating an alternative depth adjustment mechanism.

FIG. 3 shows the embodiment of the support apparatus 100 of FIGS. 1 and 2 in an unmounted, folded position, with upper clamps 110 and 120 (FIG. 2) removed (and not shown) and speed bag 160 detached. Coupled to the first bag-support member 154 are a second bag-support member 134 and a third bag-support member 144. Bag-support members 134 and 144, however, could be sized and disposed to be uncoupled from bag-support member 154, as illustrated in FIG. 5, for example. Note further that in other similar embodiments contemplated but not shown, bag-support members 134 and 144 do not necessarily exist, and vertical elements 130 and 140 could be sized and disposed to couple directly or by other configurations to bag-support member 154.

Continuing FIG. 3, vertical element 140 is coupled to bag-support member 134 via an attachment mechanism 142, which is contemplated in this embodiment to have two attachment points, facilitated here by example as a fixed pin 143 and a removable T-knob fastener 141, both of which extend through bag-support member 134 and vertical element 140. T-knob fastener 141 could be removed to allow vertical element 140 to rotate toward bag-support member 154 to the position illustrated. An attachment mechanism 132 is configured similarly. Thusly, when apparatus 100 is unmounted from doorframe 190 (FIGS. 1 and 2), upper clamp assembly 119 (FIGS. 1 and 2) could be folded down from its vertical position, toward bag-support member 154, with or without upper clamps 110 and 120 (FIG. 2) removed, and with or without speed bag 160 detached, for the purposes of storing or transporting support apparatus 100.

Figure 4:
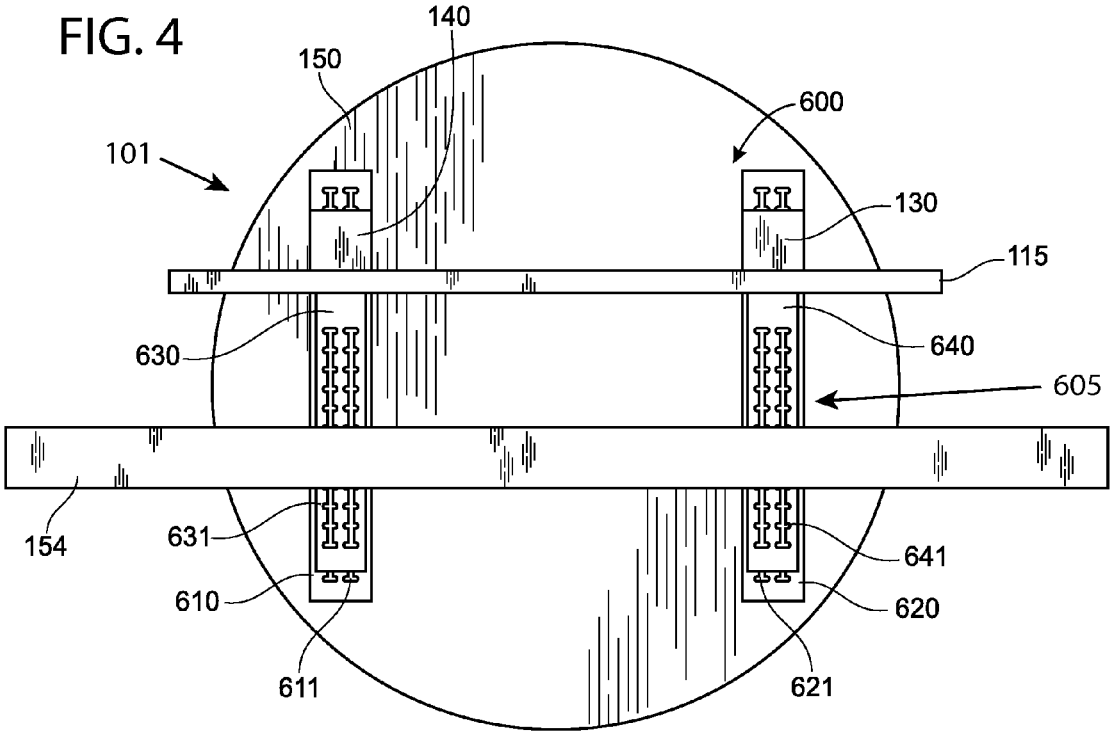
FIG. 4 is a top plan view of an alternative embodiment of the apparatus, illustrating a depth adjustment mechanism.

In FIG. 4, an alternative support apparatus 101 is illustrated comprising a first depth adjustment mechanism 600 for adjusting rebound platform 150 in relation to doorframe 190 (FIG. 2). Fixedly coupled to rebound platform 150 is a bag-support member 610 and a bag-support member 620, to which a bag-support member 630 and a bag-support member 640, respectively, are slidingly coupled. Bag-support members 610, 620, 630, and 640 comprise a plurality of coupling points 611, 621, 631 and 641, respectively, shown euphemistically to represent indents/detents into which one or more pins or tabs (not shown) may be inserted to lock bag-support members 630 and 640 to bag-support members 610 and 620, respectively, in a plurality of positions forward or backward relative to a depth of doorframe 190. In this manner, the user may position rebound platform 150 and speed bag 160 (FIGS. 1 and 2): more directly within doorframe 190 (FIGS. 1 and 2), requiring less room space, for example; or forward and away from doorframe 190 (FIGS. 1 and 2), allowing the user a wider range of movement around the front of rebound platform 150.

Continuing FIG. 4, a second depth adjustment mechanism 605 adjusts the horizontal distance between bag-support member 154 and upper clamp member 115. Bag-support member 154 is slidingly coupled to bag-support members 630 and 640. In a manner similar to adjustment mechanism 600, the plurality of coupling points 631 and 641 lock bag-support member 154 in a plurality of positions such that bag-support member 154 and upper clamp member 115 may both firmly abut doorframe 190 as shown in FIGS. 1 and 2—while keeping rebound platform 150 and the overall apparatus 101 level horizontally.

Note that in FIG. 4, clamp assemblies 119, 170 and 180 of FIG. 1 are not illustrated in order to simplify the drawing but are nonetheless envisioned. Also note that in other contemplated embodiments not shown but similar to that of FIG. 4, depth adjustment mechanisms 600 and 605 are easily adaptable for support apparatus 100 (FIGS. 1 and 2) configured for a plurality of punching bags to be used without rebound platform 150. For example, bag-support members 610 and 620 could be rigidly coupled to an additional bag-support member (e.g., bag-support member 154) comprising an attachment mechanism for a punching bag (not shown), requiring no other modification to the other elements of FIG. 4 as illustrated.

FIG. 5 illustrates an embodiment of a support apparatus 102 comprising an alternative depth adjustment mechanism 700 that is similar in purpose to depth adjustment mechanism 605 (FIG. 4). In this embodiment, however, a bag-support member 710 comprises a slot 730 and a slot 750; and a bag-support member 720 comprises a slot 740 and a slot 760. Slots 730, 740, 750, and 760 are illustrated as hidden (i.e., dashed lines), since bag-support members 710, 720, and 154 are illustrated in this embodiment as square tubes with four surfaces wherein the only slotted surface of each bag-support member 710, 720 and 154 is the one abutting platform 150. Platform 150 could comprise at least one hole (not shown) for each respective slot 730, 740, 750, and 760. Optionally, rebound platform 150 could comprise corresponding slots illustrated by the said dashed lines. Alternatively, only platform 150 could comprise slots 730, 740, 750, and 760, and bag-support members 710, 720, and 154 could each comprise at least one hole (not shown) respectively. In any of these said options, a nut 712 and a nut 714 each thread onto a bolt (not shown) through slots 730 and 750, respectively, coupling bag-support member 710 to rebound platform 150, while a nut 716 threads onto a bolt (not shown) through slot 750, coupling bag-support member 154 to rebound platform 150. Likewise, a nut 722 and a nut 724 each thread onto a bolt (not shown) through slots 740 and 760, respectively, coupling bag-support member 720 to rebound platform 150, while a nut 726 threads onto a bolt (not shown) through slot 760, coupling bag-support member 154 to rebound platform 150.

Thusly, a plurality of coupling points are provided such that bag-support member 154 and upper clamp member 115 may be positioned to both firmly abut doorframe 190 as in FIGS. 1 and 2—while keeping rebound platform 150 and the overall apparatus 102 level horizontally.

Note that in FIG. 5, the clamp assemblies 119, 170 and 180 of FIG. 1 are not illustrated in order to simplify the drawing but are nonetheless envisioned.

Figure 6:
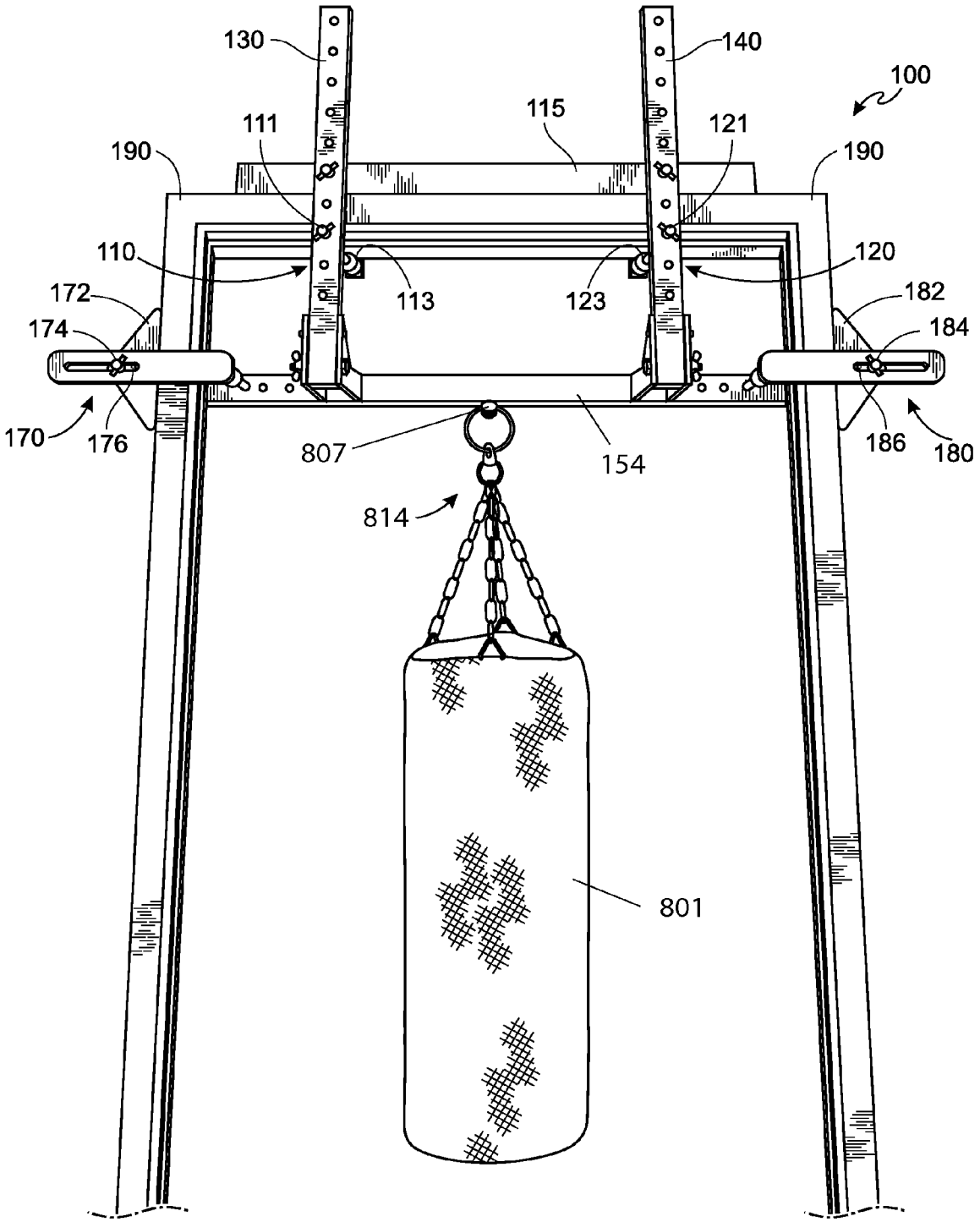
FIG. 6 is a rear perspective view of the embodiment of FIG. 1, but to which a heavy bag is attached. As in FIG. 1.

FIG. 6 shows an embodiment that uses the same component configuration of support apparatus 100 of FIGS. 1 and 2. In FIG. 6, however, attached to support apparatus 100 is a heavy bag 801 using a standard chain and swivel 814 coupled to bag-support 154 via an attachment mechanism 807.

Figure 7:
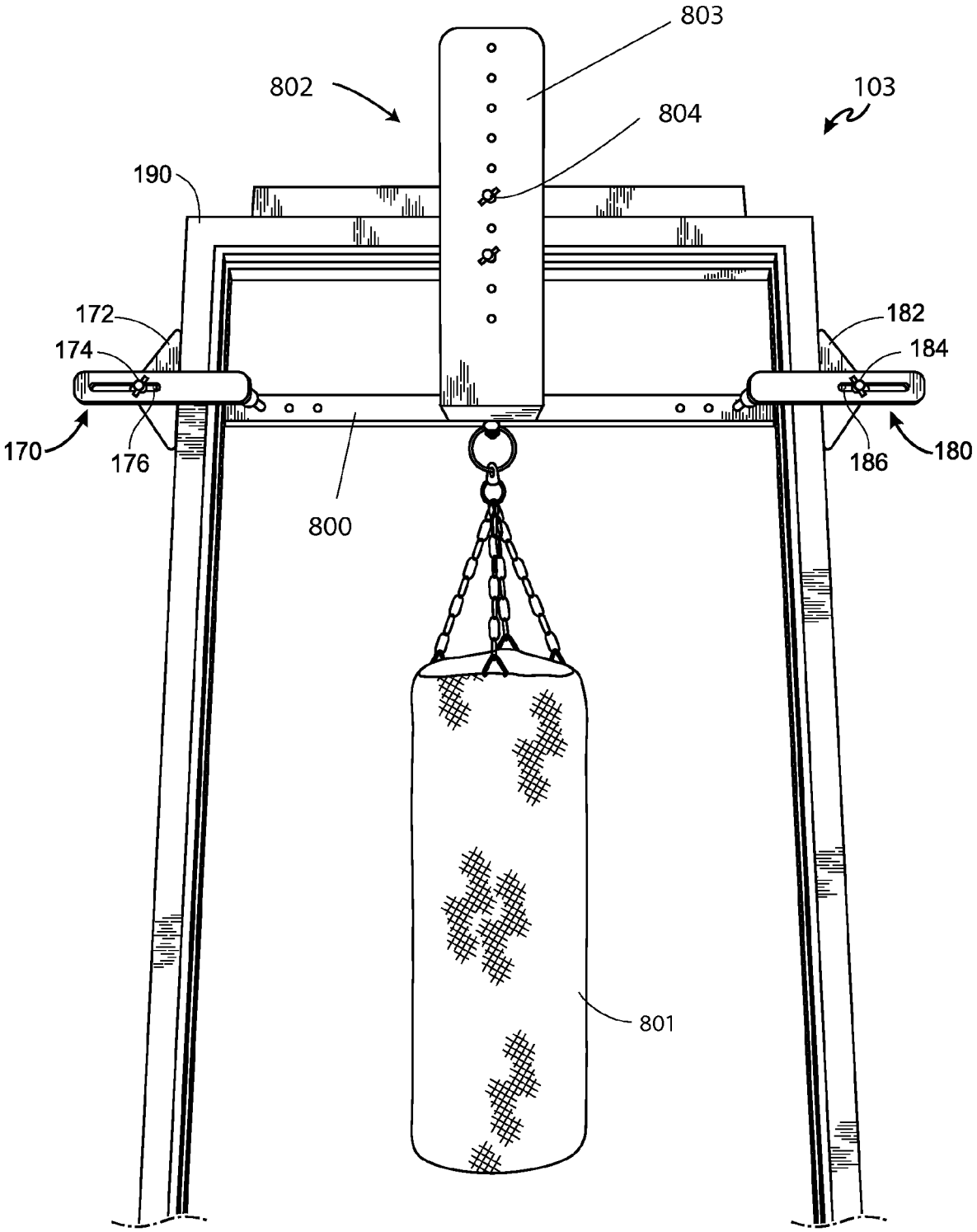
FIG. 7 is a rear perspective view of another alternative embodiment, which illustrates: a bag-support member comprising one vertical element; and an upper clamp assembly comprising one tightening mechanism and one elongated horizontal rear member.

FIG. 7 shows an embodiment that comprises a single vertical element 803 in place of vertical elements 130 and 140 (FIGS. 1 and 2). Vertical element 803 is illustrated here as a relatively flat and wide support member, although it could be sized similarly to, for example, vertical element 130 (FIG. 1). Note that other component configurations are contemplated wherein, for example, vertical element 130 (FIG. 2) is rotatably coupled to bag-support member 154 (FIG. 2)—but centered within doorframe 190, similar to the vertical element 803 of FIG. 7.

Figure 8:
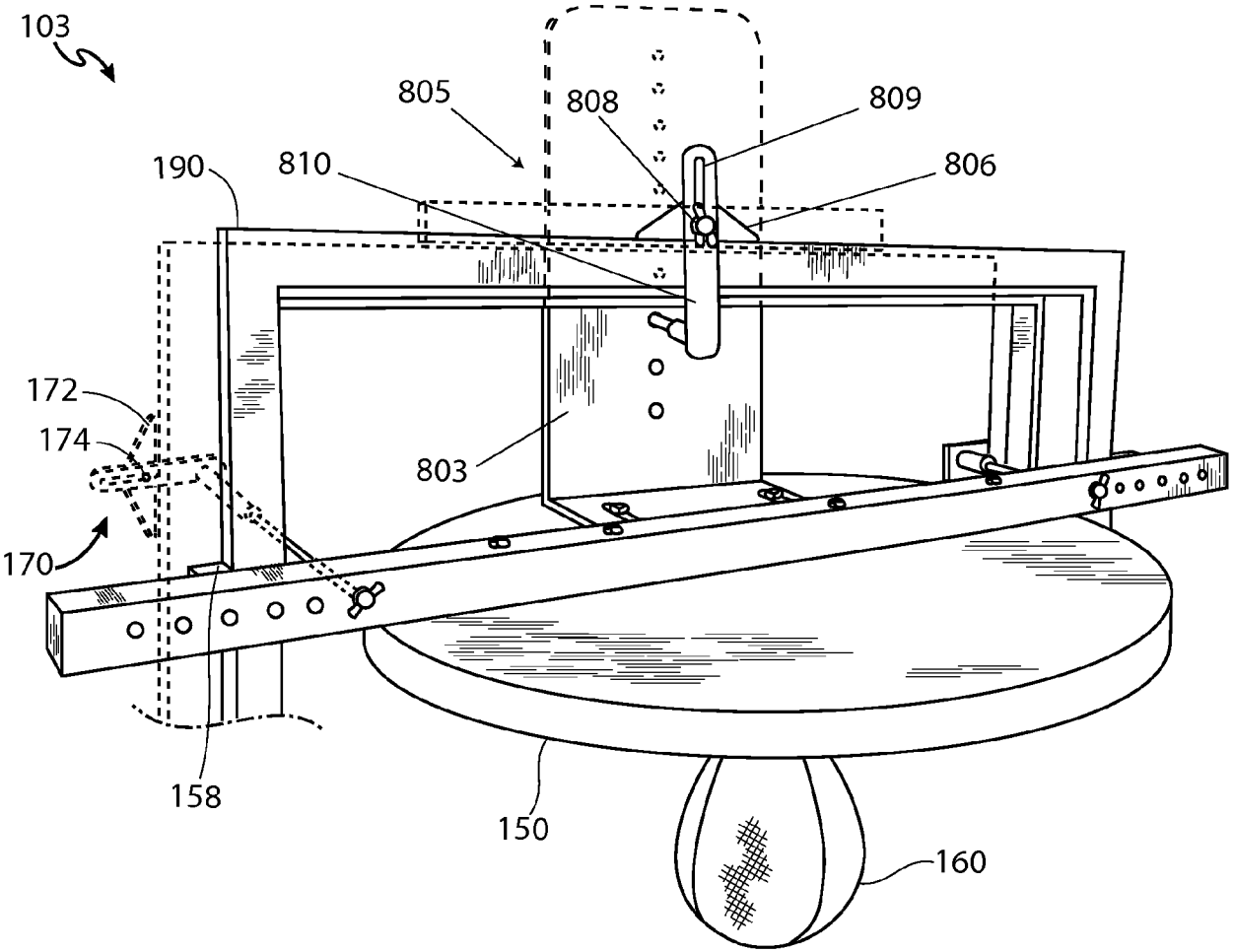
FIG. 8 is a front perspective view of the support apparatus of FIG. 7, but it shows an attached speed bag and platform rather than a heavy bag. Some hidden structures of the apparatus and doorframe are shown in dashed lines.

FIG. 8 shows a front view of the embodiment of FIG. 7, but heavy bag 801 (FIG. 7) is replaced with rebound platform 150 and speed bag 160. Some components of apparatus 103 and some surfaces of doorframe 190 that are hidden in this front view are drawn here in dashed lines. An upper clamp assembly 805 is shown as a single-clamp configuration similar to clamp 110 or clamp 120 (FIGS. 1 and 2). Note that other configurations not shown are envisioned wherein, for example, upper clamp assembly 805 comprises a plurality of upper clamps having clamp members of a plurality of sizes as described for FIGS. 1 and 2—but coupled to the single vertical element 803.

Figure 9:
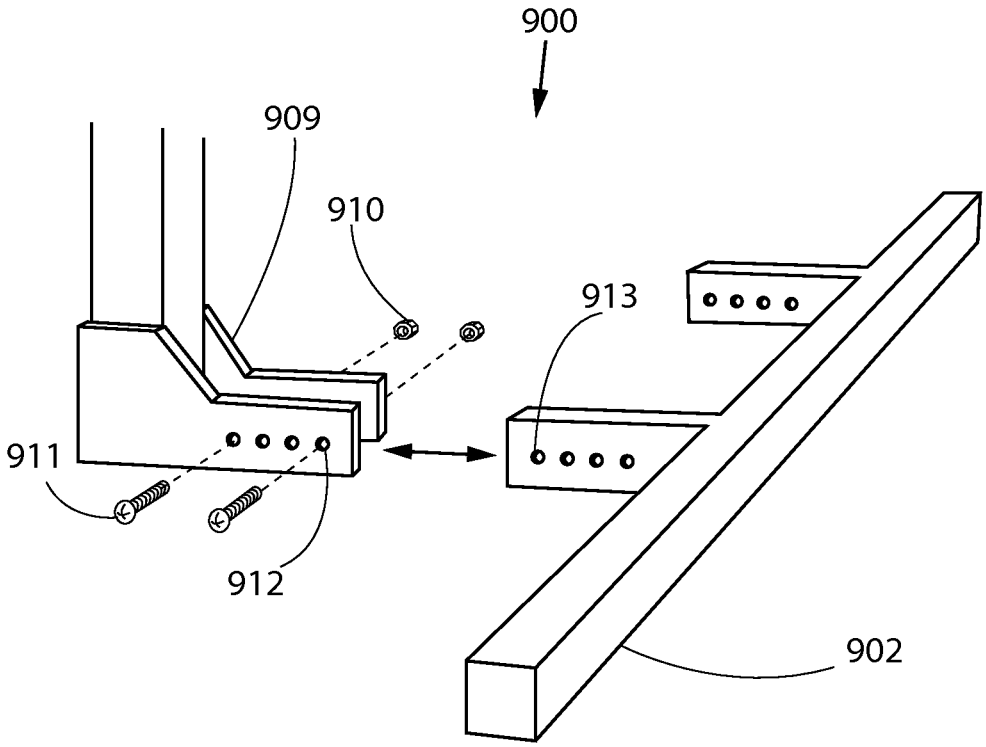
FIG. 9 is a partial, exploded view of a bag-support member, isolating the basic components of an alternative embodiment of a depth adjustment mechanism.

FIG. 9 is a partial, exploded view isolating the components of an alternative embodiment of a depth adjustment mechanism 900 and relates to support apparatus 100 (FIGS. 1, 2, 3, 6). FIG. 9 focuses on only the left-side members of depth adjustment mechanism 900. The same component configuration, however, could be mirrored for the right-side members of depth adjustment mechanism 900. Note that in alternative embodiments not shown but contemplated herein, depth adjustment mechanism 900 could be disposed in a plurality of configurations—for example, in a single, center configuration, rather than the double, left-right configuration shown.

A bag-support member 902 could be sized and disposed relative to doorframe 190 (FIG. 2) in a plurality of ways as contemplated for bag-support member 154 (FIG. 2). Bag-support member 902 is shaped, in FIG. 9, as a double "T" comprising a plurality of coupling points illustrated as a row of holes 913 drilled through the square tubing of bag-support member 902. Similarly, a bag-support member 909 could be sized and disposed relative to vertical element 130 (FIG. 2) in a plurality of ways as contemplated for bag-support member 134 (FIG. 2), and could comprise rotatable coupling mechanism 142 (FIG. 2). Additionally, bag-support member 909 comprises a plurality of coupling points illustrated as a row of holes 912 drilled through the vertical sides of bag-support member 909. Bag-support members 902 and 909 could be adjustably coupled by inserting bag-support member 902 between the vertical sides of bag-support member 909 such that the rows of holes 912 and 913 match in a position to allow bag-support member 902, and vertical elements 130 and 140 (FIG. 2), to firmly abut the front side and rear side of doorframe 190 (FIG. 2), respectively. A set of bolts 911 and a set of nuts 910 fasten the coupling between bag-support members 902 and 909.

Note that the coupling points illustrated as the rows of holes 912 and 913 are also contemplated alternatively as comprising, for example, slots, indents/detents, or other mechanisms for adjustable coupling.

Figure 10:
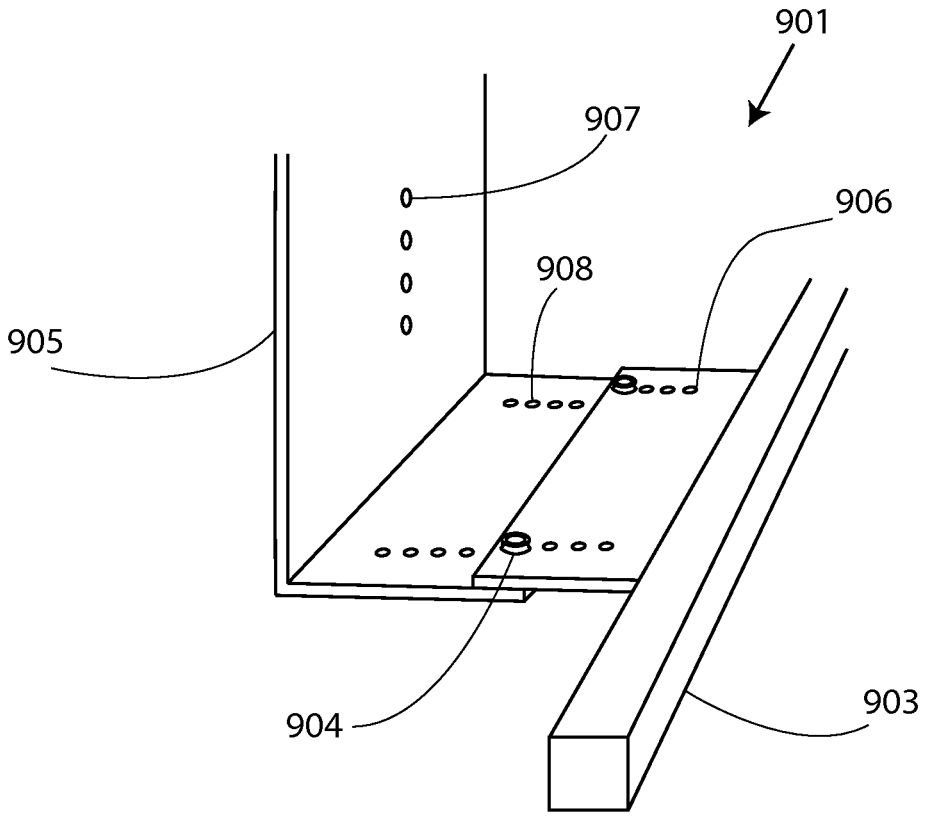
FIG. 10 is a partial, perspective view of a bag-support member, isolating another alternative embodiment of a depth adjustment mechanism.

FIG. 10 is a partial, perspective view isolating the components of another alternative embodiment of a depth adjustment mechanism 901 and relates to FIGS. 7 and 8. Note that in alternative embodiments not shown but contemplated herein, depth adjustment mechanism 901 could be disposed in a plurality of configurations—for example, a double, left-right configuration, rather than the single center configuration shown in FIGS. 7 and 8.

A bag-support member 903 could be sized and disposed relative to doorframe 190 (FIG. 7) in a plurality of ways as contemplated for bag-support member 800 (FIG. 7). Bag-support member 903 is shaped as a "T" comprising a plurality of coupling points illustrated as a pair of rows of holes 906 drilled through a flattened part of bag-support member 903. Similarly, a bag-support member 905 could be sized and disposed in a plurality of ways as contemplated for bag-support member 803 (FIG. 7) and could additionally comprise a rotatable coupling mechanism (not shown), such as a hinge, to allow the vertical part of bag-support member 905 to fold downward. In FIG. 10, bag-support member 905 comprises a plurality of coupling points illustrated as a pair of rows of holes 908 drilled through the horizontal portion of bag-support member 905. Bag-support members 903 and 905 could be adjustably coupled such that the pairs of rows of holes 906 and 908 match in a position to allow bag-support members 903 and 905 to firmly abut the front side and rear side of doorframe 190 (FIG. 2), respectively. A set of fasteners 904 fastens the coupling between bag-support members 903 and 905.

Note that the coupling points illustrated as the pairs of rows of holes 906 and 908 are also contemplated alternatively as comprising, for example, slots, indents/detents, or other known mechanisms for adjustable coupling.

Figure 11:
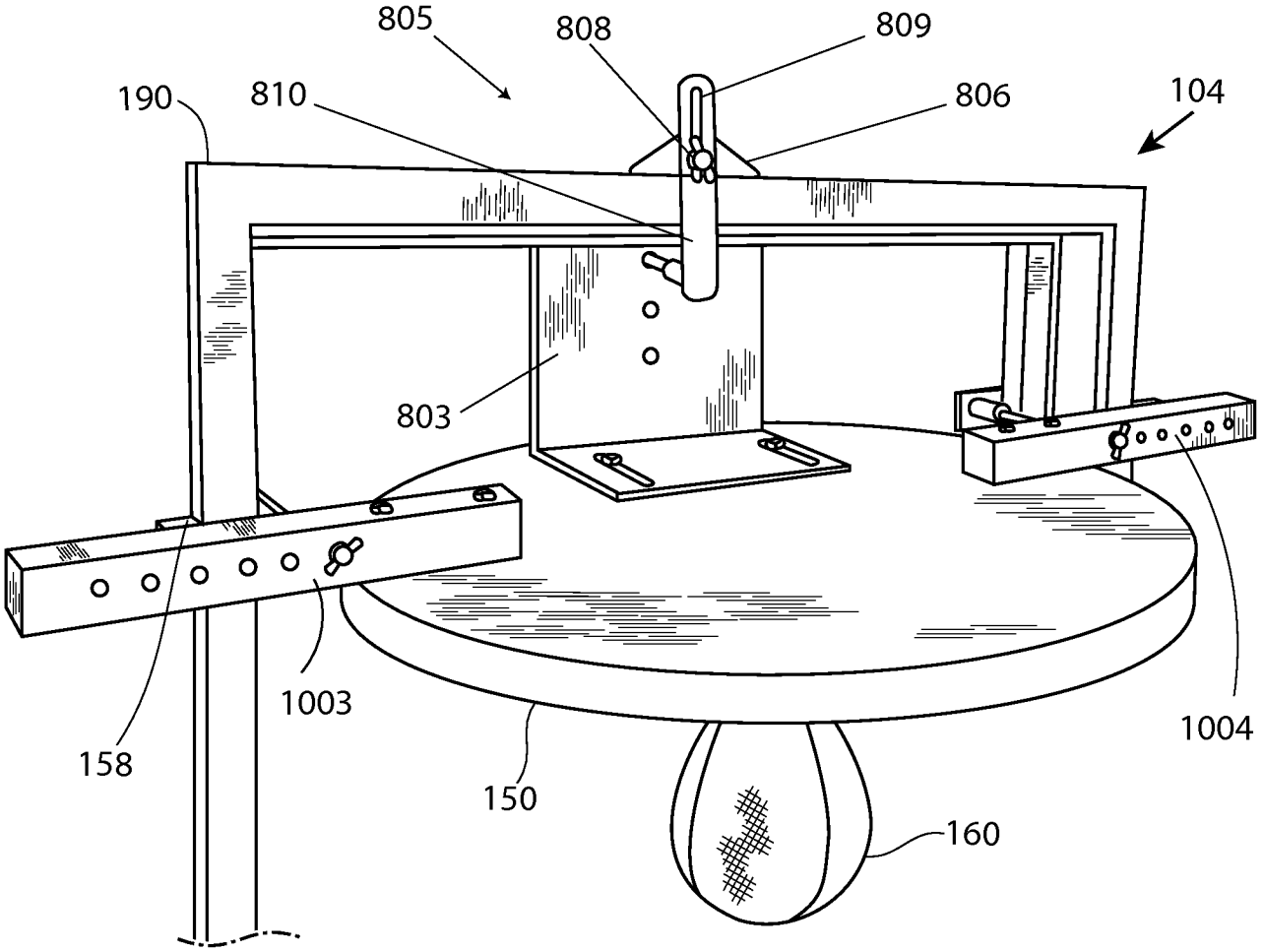
FIG. 11 is a perspective view of an embodiment similar to that of FIG. 8, illustrating a left-side bag-support member and a right-side bag-support member that also serve as a front member of a left-side clamp and a front member of a right-side clamp, respectively.

FIG. 11 shows an embodiment similar to that of FIG. 8. However, a support apparatus 104 comprises a left-side bag-support member 1003 and a right-side bag-support member 1004. In this illustration, bag-support members 1003 and 1004 are each coupled directly to rebound platform 150, although a plurality of configurations are contemplated. For example, an embodiment is envisioned wherein bag-support members 1003 and 1004 each comprise an additional thin, flat portion (not shown) similar to that of bag-support member 903 (FIG. 10) that could adjustably couple to vertical element 803. Alternatively, bag-support members 1003 and 1004 could comprise or couple to members (not shown) similar to bag-support members 134 and 144 (FIG. 3).

Other embodiments can be contemplated within the scope of these teachings that could support a plurality of punching bags with or without a rebound platform.

In fact, it should be apparent to those skilled in the art that many more configurations and embodiments are possible without departing from the inventive concepts disclosed herein. These teachings, therefore, are not to be restricted except in the scope of the appended claims. Moreover, in the interpretation of both the specification and the claims, all terms should be interpreted in the broadest possible manner consistent with the context. In particular, the term "comprise," in all its forms, should be interpreted as referring to elements, members, components, or steps in a non-exclusive manner, indicating that the referenced elements, members, components, or steps may be present, or utilized, or combined with other elements, members, components, or steps that are not expressly referenced. Where the specification or the claims refer to at least one of something selected from the group consisting of A, B, C, . . . and N, the text should be interpreted as requiring only one element from the group, not A plus N, or B plus N, etc. Also, the words "a" and "an" in the claims should be taken as denoting "at least one" even if "at least one" appears in other claim wording.

I claim:

1. A support apparatus comprising:

a) a support member disposed horizontally to span at least a substantial portion of a width of an architectural frame and having a plurality of coupling points;

b) a first clamp adjustably coupled with said support member by means of said plurality of coupling points whereby the first clamp is disposed proximate to a left side of said architectural frame;

c) a second clamp adjustably coupled with said support member by means of said plurality of coupling points whereby the second clamp is disposed proximate to a right side of said architectural frame;

wherein the apparatus, as operatively secured by tensioning the first clamp and the second clamp respectively to the left side and the right side of the architectural frame, is sufficient to achieve effective support and stability for use of a punching bag coupled to the apparatus.

2. A support apparatus comprising:

a) a support member disposed horizontally to span at least a substantial portion of a width of an architectural frame and having a plurality of coupling points disposed horizontally to span a depth of the architectural frame;

b) a first clamp coupled with said first support member and disposed proximate to a left side of said architectural frame;

c) a second clamp coupled with said first support member and is disposed proximate to a right side of said architectural frame;

wherein the apparatus, as operatively secured by tensioning the first clamp and the second clamp respectively to the left side and the right side of the architectural frame, is sufficient to achieve effective support and stability for use of a punching bag coupled adjustably to the apparatus by means of said plurality of coupling points relative to said depth of said architectural frame.

3. A support apparatus comprising:

a) a first support member disposed horizontally to span at least a substantial portion of a width of an architectural frame;

b) a second support member disposed vertically to span at least a portion of a height of said architectural frame and rotatably coupled with said first support member relative to a horizontal axis whereby said members may be operatively folded toward or away from each other for optimal mounting or storage configuration;

c) a first clamp coupled with said first support member and disposed proximate to a left side of said architectural frame;

d) a second clamp coupled with said first support member and disposed proximate to a right side of said architectural frame;

e) a third clamp adjustably coupled with said second support member by means of a plurality of coupling points disposed vertically whereby the third clamp is disposed proximate to an upper portion of said architectural frame;

wherein the apparatus, as operatively secured to the architectural frame by tensioning said clamps to said architectural frame, is sufficient to achieve effective support and stability for use of a punching bag coupled to the apparatus.

* * * * *